US006450001B1

(12) United States Patent
Kimura

(10) Patent No.: US 6,450,001 B1
(45) Date of Patent: Sep. 17, 2002

(54) METHOD AND APPARATUS FOR MANUFACTURING THICK-WALLED BENT PIPE

(75) Inventor: Yoichi Kimura, Tokyo (JP)

(73) Assignee: Tokiwa Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/715,093

(22) Filed: Nov. 20, 2000

(51) Int. Cl.[7] ..... B21D 7/04

(52) U.S. Cl. ..... 72/389.8; 72/389.3; 72/383; 72/387

(58) Field of Search ..... 72/383, 389.3, 72/389.8, 387, 388

(56) References Cited

FOREIGN PATENT DOCUMENTS

| | | | | |
|---|---|---|---|---|
| DE | 3150426 | * 7/1983 | ..... | 72/389.8 |
| DE | 283084 | * 10/1990 | ..... | 72/389.8 |
| GB | 2122521 | * 1/1984 | ..... | 72/389.8 |
| JP | 39-10727 | * 6/1964 | ..... | 72/389.8 |
| JP | 59-163024 | 9/1984 | | |
| JP | 62-3831 | * 1/1987 | ..... | 72/389.8 |
| SU | 1278064 | * 12/1996 | ..... | 72/389.8 |

* cited by examiner

*Primary Examiner*—David Jones
(74) *Attorney, Agent, or Firm*—Armstrong, Westerman & Hattori, LLP

(57) ABSTRACT

A method and apparatus for manufacturing a thick-walled bent pipe capable of manufacturing an elbow material for piping with higher size accuracy with use of a thick-walled pipe material are provided. For this purpose, the manufacturing apparatus includes a lower die (20) including a pair of bottom dies (21, 22) having sliding surfaces (**20*c*, 20*c*) in a circular arc form; an upper die (10) including an upper guide (11) having a guide surface (11*a*) in a circular arc form for guiding the lower die (20), and a presser die (12); and a lower guide (30) having slide surfaces (30*a*, 30*a*) for placing the bottom dies (21, 22) thereon, and the bottom dies (21, 22) are respectively allowed to rotate while they are facing to each other, by lower end portions (20*f*, 20*f*) of the bottom dies (21, 22) respectively abutting to and sliding along the slide surfaces (30*a*, 30*a*) at the same time when the sliding surfaces (20*c*, 20*c*) respectively abut to and slide along the guide surface (11*a*) in the circular arc form in connection with descent of the upper die (10**).

6 Claims, 14 Drawing Sheets

METHOD AND APPARATUS FOR MANUFACTURING THICK-WALLED BENT PIPE

TECHNICAL FIELD

The present invention relates to a method and an apparatus for manufacturing a thick-walled bent pipe.

BACKGROUND ART

As for a metal elbow for piping, one with an elbow body 111 being attached to a piping block 113 or the like with a fastening nut 112 as shown in FIG. 8, is used conventionally. Both ends of the elbow body 111 are threaded, and one thread is screwed into the piping block 113 or the like and fastened with the nut 112, while a pipe not shown is attached to the other thread. The elbow body 111 can be freely oriented to the piping and fixed by being fastened with the nut 112. The elbow body 111 is provided with parallel plane portions 111*s* and 111*s* so that the elbow body 111 can be fixed with a spanner or the like when it is attached. Further, the elbow body 111 is bent at almost the right angle, which reduces the protruding amount from the piping block 113 or the like, thus requiring less piping space.

In a section of the elbow body 111, two fluid paths 111*d* and 111*d* cross each other at almost the right angle as shown in FIG. 9. Further, since the elbow needs to be threaded, a margin to cut needs to be secured, which makes a material for the elbow thick-walled. In addition, it is necessary to secure pressure resistance of an elbow in order to respond to high-pressurization of the fluid devices in recent years, and the wall thickness of the elbow body 111 after being worked becomes larger.

Accordingly, it is difficult to manufacture the elbow body 111 as shown in FIG. 9 by bending a thick-walled metal pipe at a small radius, since the pipe is crushed or the wall thickness of the pipe is reduced. Thus, a material of the elbow is made by cutting out a thick metal plate and forming it into a right-angle elbow, then the material is drilled from both end sides thereof to make the fluid passages 111*d* and 111*d* crossing each other at almost the right angle, and thereafter screw thread cutting is performed for both ends to thereby manufacture the elbow body 111.

However, in the above manufacturing method, the process of cutting the material includes two drilling operations and two screw thread cutting operations, which results in too many working steps, and thus the number of steps of preparing the material is large. Further, burrs caused by drilling occur at a crossing portion of the fluid passages 111*d* and 111*d* crossing each other at almost the right angle, which are made by drilling. Thus, an operation for removing the burrs that have occurred has to be performed, and the deburring operation is not easy and takes time, since burrs in the small holes have to be removed. Further, many cutting operations increase cutting amount of the material, thus reducing yields. Consequently, manufacturing cost is increased.

In order to eliminate the above disadvantages, a method for manufacturing a curved pipe material described in Japanese Patent Laid-open No. 59-163024 as shown in FIG. 10 to FIG. 12B is proposed. An apparatus thereof has a presser die A and press bearer dies B and C for supporting guide shafts b and c symmetrically positioned and respectively attached below the presser die A so as to be rotatable and horizontally slidable by inserting though and supporting them by horizontally long holes p and q provided in corresponding support frames P and Q. Bearing portions 2*b* and 3*c* for securely supporting both end portions of a straight pipe-shaped semiprocessed product N, which is formed by performing predetermined forging or grinding for a round metal bar, are respectively formed on the press bearing dies B and C. With the apparatus as described above, a thick-walled curved pipe can be manufactured by placing the straight pipe-shaped semiprocessed product N on the press bearing dies B and C, and lowering the press presser die A to thereby press and bend the straight pipe-shaped semiprocessed product N.

However, the method of manufacturing the curved pipe material described in Japanese Patent Laid-open No. 59-163024 has the following disadvantages.

The straight pipe-shaped semiprocessed product N is provided with a pipe hole 1 and bulging parts for connection at both ends as shown in FIG. 12A. A pipe part 4 is provided with uneven wall thickness on an upper side and an lower side with wall thickness being made smaller on the upper side and larger on the lower side as shown in FIG. 12B. Accordingly, forging or grinding, and boring are performed to form the round bar-shaped material into the straight pipe-shaped semiprocessed product N as described above, thus requiring plenty of time to perform the working.

Further, when the straight pipe-shaped semiprocessed product N is pressed and bent, the press bearing dies B and C are moved transversely within the ranges of the horizontally long holes p and q to widen a space between them following the deformation of the straight pipe-shaped semiprocessed product N, while rotating as shown in FIG. 11. The moving amount is determined by an outer shape dimension and wall thickness dimension of the straight pipe-shaped semiprocessed product N, and the aforesaid moving amount varies according to the variations in the outer shape dimension and the wall thickness dimension of the straight pipe-shaped semiprocessed product N. Accordingly, the dimension of the straight pipe-shaped semiprocessed product N in a longitudinal direction thereof, that is, a dimension in the left and right direction in FIG. 11 varies within the range of the horizontally long holes p and q in which the dies B and C move transversely to widen the space between them. Specifically, the longitudinal dimension of the straight pipe-shaped semiprocessed product N changes and varies. If the dimension of the straight pipe-shaped semiprocessed product N varies, positioning becomes difficult when machining is performed in the next process, which is not preferable.

SUMMARY OF THE INVENTION

The present invention is made in view of the above disadvantages, and its object is to provide a method and an apparatus for manufacturing a thick-walled bent pipe capable of manufacturing an elbow material for piping with higher size accuracy with use of a thick-walled pipe material.

In order to attain the above object, a method for manufacturing a thick-walled bent pipe according to the present invention has a configuration including the steps of:

- placing a thick-walled metal pipe material of a predetermined length on a lower die including a pair of bottom dies having sliding surfaces each in a circular arc form and placed on slide surfaces of a lower guide;
- pressing a middle portion in a longitudinal direction of the thick-walled metal pipe material by means of an upper die including an upper guide having a guide surface in a circular arc form for guiding the lower die, and a presser die;

rotating the bottom dies respectively while they are facing to each other, by lower end portions of the bottom dies respectively abutting to and sliding along the slide surfaces at the same time when the sliding surfaces abut to and slide along the guide surface in the circular arc form to thereby bend the thick-walled metal pipe material.

According to the above configuration (a first configuration of the method), a pair of bottom dies of the lower die rotate along the guide surface in the circular arc form of the upper die having a center of rotation while they are facing to each other. Thereby, changes in the distances between both the end surfaces of the thick-walled pipe material and the center of rotation at the start of bending and at the completion of bending are reduced, thus making it possible to form a thick-walled elbow material with less variations in size.

As a result, an elbow material can be provided by cutting the thick-walled pipe, thus making it unnecessary to prepare a forged material. Further, since a thick-walled pipe can be used, drilling for making small holes to form fluid passages is unnecessary, and deburring at the crossing portion of the drilled holes, which is conventionally performed, is made unnecessary. Further, since the thick-walled pipe has a round outer shape, the margin to cut for screw thread cutting is reduced. Accordingly, a special drill is not needed, and the time required for working, and tool cost can be substantially reduced, and the yield of the material can be improved.

Further, the hole in the thick-walled elbow material thus formed is not a crossing drilled hole as in the conventional art, but is a smoothly curved hole, thus making it possible to reduce pressure loss of a fluid passing through the elbow. Further, the bending angle can be set at will by adjusting the descending stroke of the upper die, thus making it easy to manufacture many kinds of thick-walled elbow materials with different bending angles.

Further, the method for manufacturing the thick-walled bent pipe may have a configuration in which both end surfaces of the thick-walled metal pipe material are restrained by a stopper provided in the bottom dies.

According to the above configuration (a second configuration of the method), bending work is performed with the thick-walled pipe material being restrained so that it has a size set by the upper die, the lower die and the stopper, thus making it possible to form the thick-walled elbow material of accurate size.

Further, the method for manufacturing the thick-walled bent pipe may have a configuration in which, the stopper includes a first stopper and a second stopper which are allowed to slide in the bottom dies in the longitudinal direction of the thick-walled metal pipe material, the first stopper and the second stopper are guided to be closer to the guide surface in the circular arc form as the first stopper and the second stopper are at an upper portion of the upper guide by stopper guide surfaces provided on the upper guide, and the first stopper and the second stopper push both the end surfaces of the thick-walled pipe material toward a center portion in the longitudinal direction when the bottom dies rotate.

According to the above configuration (a third configuration of the method), the first stopper and the second stopper are respectively slidable in the longitudinal direction. Further, one end surfaces of the first stopper and the second stopper abut to and slide along the stopper guide surfaces so that they are closer to the guide surface in the circular arc form of the upper guide as they are at the upper portion of the upper guide. Thus, the other side surfaces of the first stopper and the second stopper can push against both the end surfaces of the pipe material during bending while they are serving as the stoppers for both the end surfaces of the pipe material.

As a result, the pipe material is accurately formed into the thick-walled elbow material of a size set by the one end surface of the first stopper and the one end surface of the second stopper respectively abutting along the stopper guide surfaces. Further, by replacing the fist stopper and the second stopper with those of different lengths, various kinds of thick-walled elbow materials of different sizes can be manufactured with one kind of dies.

An apparatus for manufacturing a thick-walled bent pipe according to the present invention has a configuration including:

a lower die including a pair of bottom dies having sliding surfaces each in a circular arc form;

an upper die including an upper guide having a guide surface in a circular arc form for guiding the lower die, and a presser die; and a lower guide having slide surfaces for placing the bottom dies thereon, and a configuration in which the bottom dies are allowed to rotate respectively while they are facing to each other, by lower end portions of the bottom dies respectively abutting to and sliding along the slide surfaces at the same time when the sliding surfaces respectively abut to and slide along the guide surface in the circular arc form in connection with descent of the upper die.

According to the above configuration, the same operational effects as in the first configuration of the above method can be obtained.

Further, the apparatus for manufacturing the thick-walled bent pipe may have a configuration in which, the bottom dies are provided with a stopper abutting to both end surfaces in a longitudinal direction of a material to be worked. According to the above configuration, the same operational effects as in the second configuration of the above method can be obtained.

Further the apparatus for manufacturing the thick-walled bent pipe may have a configuration in which, the stopper includes a first stopper and a second stopper which are allowed to slide in the bottom dies in the longitudinal direction of the material to be worked;

the upper guide is provided with stopper guide surfaces; and the stopper guide surfaces respectively guide the first stopper and the second stopper so that the first stopper and the second stopper are closer to the guide surface in the circular arc form as the first stopper and the second stopper are at an upper portion of the upper guide.

According to the above configuration, the same operational effects as in the third configuration of the above method can be obtained.

BRIEF DESCRIPTION OF THE DRAWINGS

FIG. 3A is an explanatory view of the thick-walled pipe material provided to be worked, and FIG. 3B is an explanatory view of the thick-walled elbow material after being worked;

FIG. 4A shows a state in which a pipe material is placed on a lower die. FIG. 4B shows a state in which a protruded portion of a presser die abuts to the pipe material, FIG. 4C shows a state in a middle step of bending the pipe material, and FIG. 4D shows a state in a final step of bending the pipe material;

FIG. 10 shows a state at the start of bending a straight pipe-shaped semiprocessed product, and FIG. 11 shows a state in which the straight pipe-shaped semiprocessed product is further pressed and bent;

BEST MODE FOR CARRYING OUT THE INVENTION

Preferred embodiments according to the present invention will be explained below with reference to the drawings.

A first embodiment will be explained based on FIG. 1 to FIG. 4D.

Figure 1:
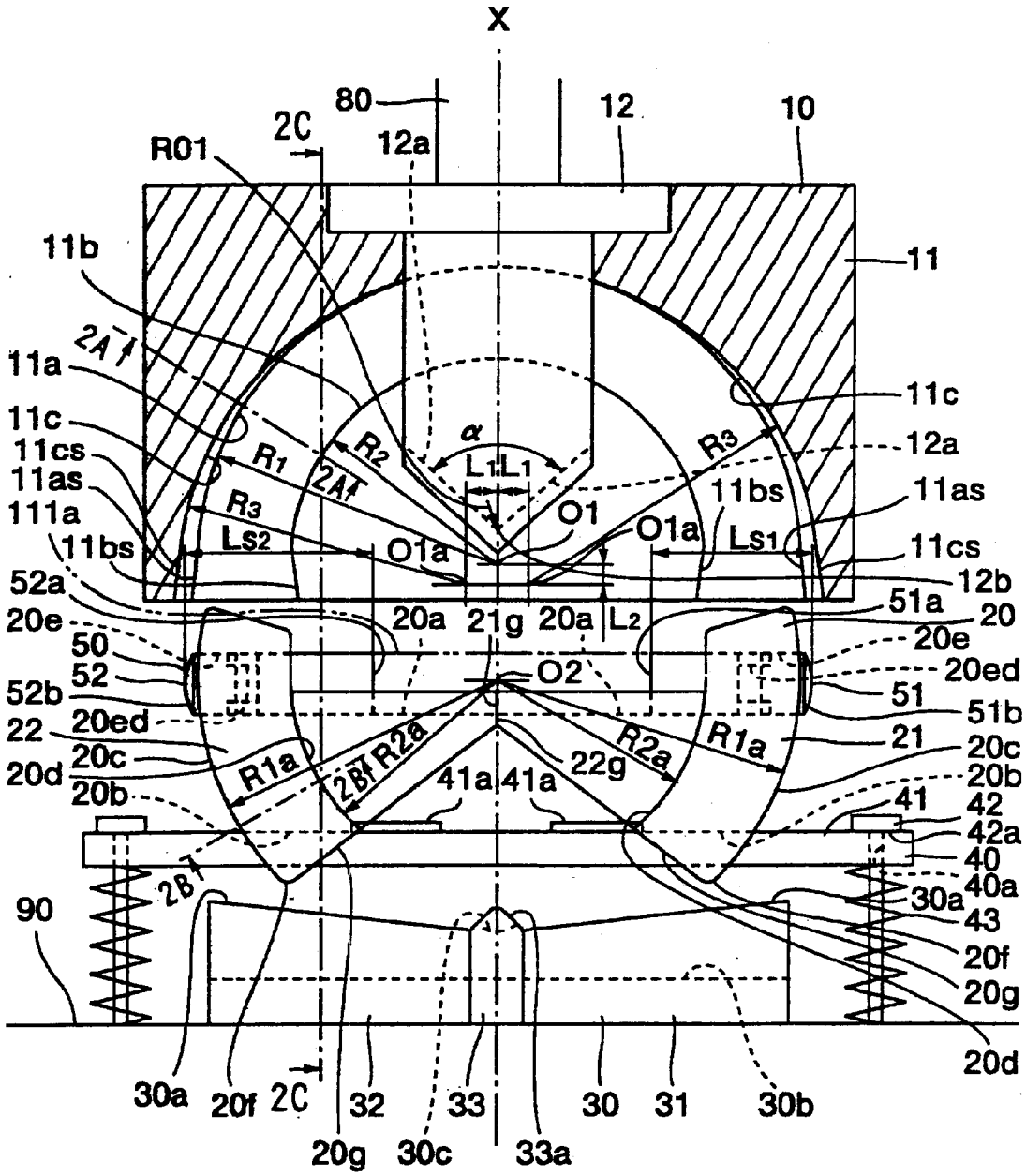
FIG. 1 is a view according to a first embodiment of the present invention, and is an explanatory view of an apparatus for manufacturing a thick-walled bent pipe in a state in which a thick-walled pipe material is placed thereon.

FIG. 1 depicts a state in which a thick-walled pipe material 111*a* shown by a two-dot chain line is placed on an apparatus for manufacturing a thick-walled bent pipe. In this embodiment, the thick-walled pipe material 111*a* is used as a material 111*a* to be worked. An upper die 10 is attached at a lower end of a ram 80 of a press or the like to be ascendable and descendable. A lower die 20 is mounted on a support 40 attached to a fixed frame 90 to be movable up and down. A lower guide 30 for receiving the lower die 20 is attached to the fixed frame 90. The lower die 20 and the lower guide 30 are disposed with centers thereof being aligned with a vertical center line X of the upper die 10.

The upper die 10 has an upper guide 11 part of that is shown in a section in FIG. 1 and a presser die 12. As shown in FIG. 2C, the presser die 12 is provided in a center portion of the upper guide 11, and a protruded portion 12*b* is placed between guide surfaces 11*a* and 11*a* in a circular arc form of the upper guide 11. In the protruded portion 12*b* provided at an lower end portion of the presser die 12, grooves 12*a* and 12*a* in a circular arc form in section, which conform to an outer shape of a thick-walled elbow material 111*b*, are symmetrically provided on both sides of the vertical center line X. The grooves 12*a* and 12*a* in the circular arc form in section are connectingly formed at an angle α corresponding to a bending angle of the thick-walled elbow material 111*b*, for example, 90 degrees, with a tip end portion of the protruded portion 12*b* as the vertex. An R surface with the radius of R01, for example, 2 mm, which is so small that it gives no flaw on the thick-walled elbow material 111*b* during forming, is formed at top portions of the grooves 12*a* and 12*a* in the circular arc form in section.

The lower die 20 is guided by the upper guide 11, which is provided with the guide surface 11*a* in a circular arc form with a radius R1 having a center O1 on the vertical axis X. An inner side surface 11*b* in a circular arc form with a radius R2 also having the center O1 is provided in an inner side of the guide surface 11*a*. Further, the upper guide 11 is provided with stopper guide surfaces 11*c* and 11*c* in a circular arc form with a radius R3 having two different centers O1*a* and O1*a*, which guide a first stopper 51 and a second stopper 52. The centers O1*a* and O1*a* are located to be separated from the center O1 by a predetermined length L1 leftward and rightward in a horizontal direction and by a predetermined length L2 downward in a vertical direction from the center O1. Vertical positions of the stopper guide surfaces 11*c* and 11*c* near the vertical center line X are conformed to that of the guide surface 11*a*. Specifically, the stopper guide surfaces 11*c* and 11*c* are made closer to the guide surface 11*a* as they are at the upper portion of the upper guide 11. The stopper guide surfaces 11*c* and 11*c* are closer to the center O1 as they are at the upper portion of the upper guide 11. Chamfers H*as* and H*as* are provided at both end portions of the guide surface 11*a* in the circular arc form, chamfers 11*bs* and 11*bs* are provided at both end portions of the inner guide surface 11*b* in the circular arc form, and chamfers 11*cs* and 11*cs* are provided at the respective lower end portions of the stopper guide surfaces 11*c* and 11*c* in the circular arc form so that the lower die 20 smoothly abut to the upper die 10 when the upper die 10 descends to abut to the lower die 20.

Figure 2A:
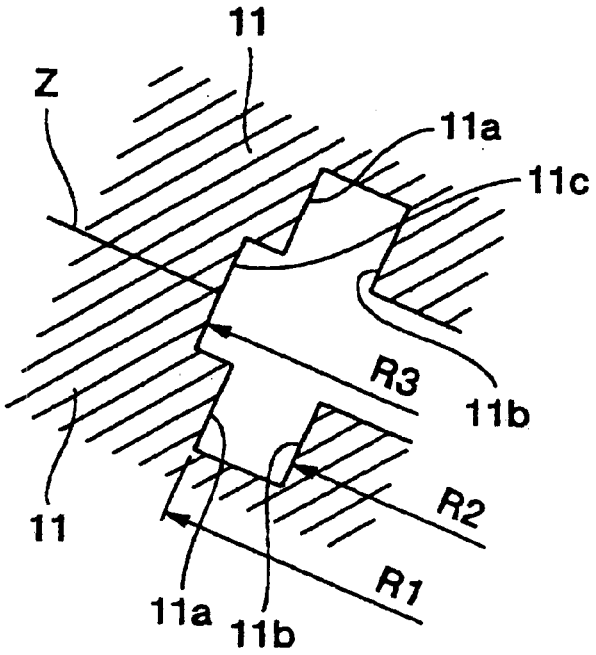
FIG. 2A is a sectional view taken along the 2A—2A line in FIG. 1.

As shown in FIG. 2A being a sectional view taken along the 2A—2A line in FIG. 1, the stopper guide surfaces 11*c* and 11*c* in the circular arc form with the radius R3 are provided in a center portion in a width direction of the upper guide 11. The guide surface 11*a* in the circular arc form with the radius R1 and the inner guide surface 11*b* in the circular arc form with the radius R2 are provided outside the stopper guide surfaces 11*c* and 11*c* of the upper guide 11 in a width direction of the stopper guide surfaces 11*c* and 11*c* of the upper guide 11.

In this embodiment, the upper guide 11 is made to be a two-split on a split surface Z shown in FIG. 2A, and is fixed integrally with the presser die 12 by means of a bolt and the like (not shown) to define the upper die 10, but the upper die 10 may be defined by the upper guide 11 and the presser die 12, which are made of one component.

The stopper guide surfaces 11*c* and 11*c* may not be aligned with the guide surface 11*a* at the vertical position near the vertical center line X. In this case, the stopper guide surfaces 11*c* and 11*c* may only be closer to the guide surface 11*a* as they are at the upper portion of the upper guide 11. As for the circular arc form of the stopper guide surfaces 11*c* and 11*c*, they may be guide surfaces in a circular arc form having the same center and the same radius on the vertical center line X at a position separated by a predetermined distance downward from the center O1, and in addition the stopper guide surfaces 11*c* and 11*c* may be closer to the guide surface 11*a* as they are at the upper portion of the upper guide 11.

The lower die 20 is defined by a pair of bottom dies 21 and 22. In the bottom dies 21 and 22, the respective end surfaces 21*g* and 22*g* abut to each other on the vertical center line X. The pair of bottom dies 21 and 22 are respectively provided with sliding surfaces 20*c* and 20*c* each in a circular arc form having a center O2 on the vertical center line X with radiuses R1*a* and R1*a*. At an inner side of the sliding surfaces 20*c* and 20*c*, inner sliding surfaces 20*d* and 20*d* in a circular arc form having the center O2 with radiuses R2*a* and R2*a* are provided.

Figure 2B:
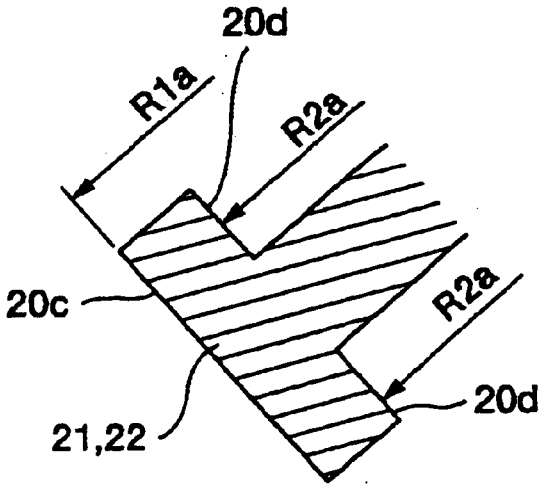
FIG. 2B is a sectional view taken along the 2B—2B line in FIG. 1.
Figure 2C:
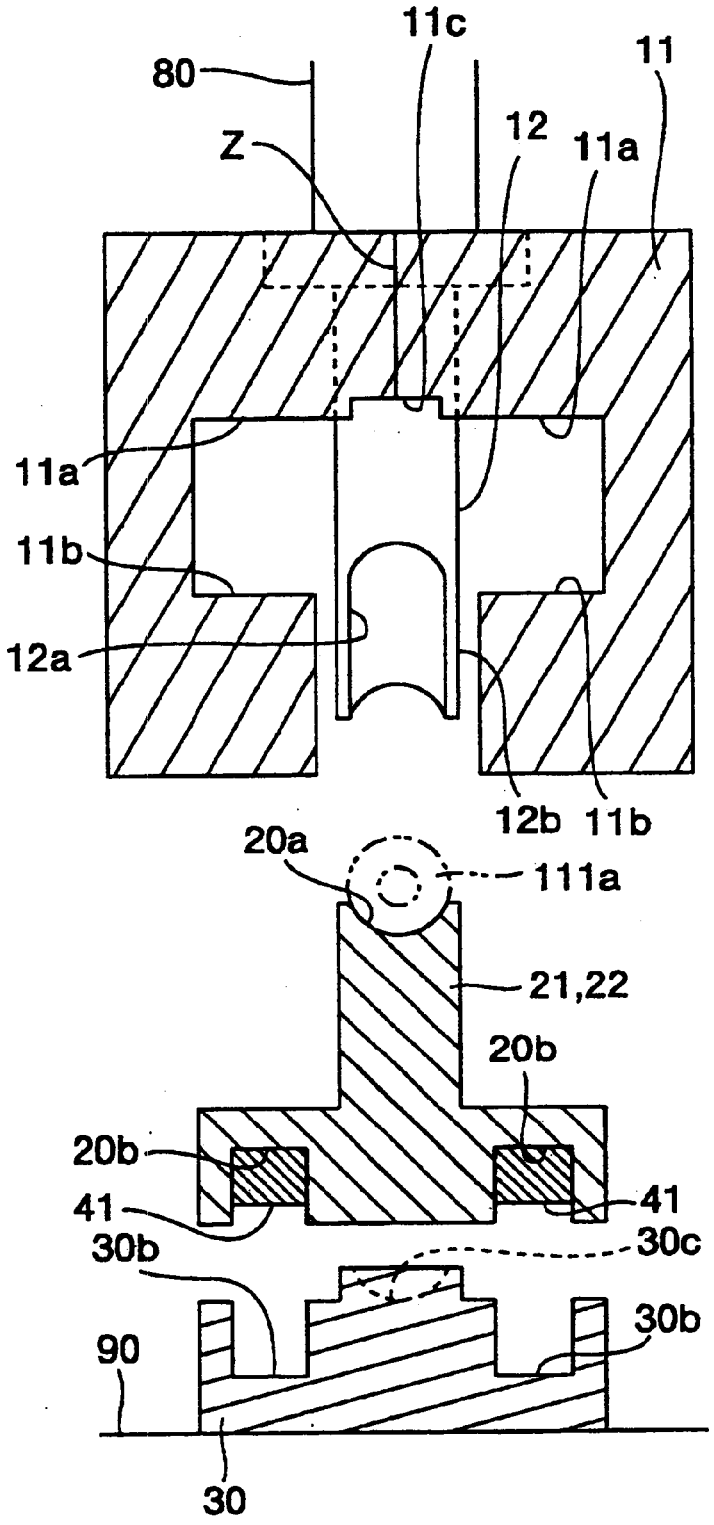
FIG. 2C is a sectional view taken along the 2C—2C line in FIG. 1.

As shown in FIG. 2B being a sectional view taken along the line 2B—2B in FIG. 1, sections of the pair of bottom dies 21 and 22 form a T-shape. The sliding surface 20*c* is designed to be a surface with a large width, and the inner sliding surface 20*d* is provided as two surfaces with smaller widths at the inner side of the sliding surface 20*c*.

The radiuses R1*a* and R1*a* of the sliding surfaces 20*c* and 20*c* in the circular arc form are made slightly smaller relative to the radius R1 of the guide surface 11*a* in the circular arc form of the upper guide 11. Specifically, a very small clearance of, for example, 0.1 mm is provided between the guide surface 11*a* and the sliding surfaces 20*c* and 20*c*. The radiuses R2*a* and R2*a* of the inner sliding surfaces 20*d* and 20*d* in the circular arc form are made slightly larger than the radius R2 of the inner guide surface 11*b* in the circular arc form of the upper guide 11. Specifically, a very small clearance of, for example, 0.1 mm is provided between the inner sliding surfaces 20*d* and 20*d* and the inner guide surface 11*b*.

The inner guide surface 11*b* of the upper guide surface 11 and the inner slide surfaces 20*d* and 20*d* of the lower die 20 are for stabilizing the rotation of the pair of bottom dies 21 and 22, but they may not be provided.

Support grooves 20*b* and 20*b* with U-shaped sections and open bottoms for placing the bottom dies 21 and 22 on a pair of support rods 41 and 41 are provided in lower portions of the pair of bottom dies 21 and 22. Grooves 20*a* and 20*a* with circular arc sections conforming to the outer shape of the thick-walled elbow material 111*b* after forming are respectively provided in upper portions of the bottom dies 21 and 22.

Holes 20*e* and 20*e* for inserting the first stopper 51 and the second stopper 52 for abutting to the end surfaces of the thick-walled pipe material 111*a* placed are respectively provided in upper portions of the bottom dies 21 and 22 and at end portions on extension lines of the grooves 20*a* and 20*a*. Step portions 20*ed* and 20*ed* are respectively provided at center portions of the holes 20*e* and 20*e*.

A stopper 50 has the first stopper 51 and the second stopper 52. The first stopper 51 and the second stopper 52 have end surfaces 51*a* and 52*a* in a plane form at one end surfaces and end surfaces 51*b* and 52*b* in a spherical form at the other end surfaces respectively. The first stopper 51 and the second stopper 52 are respectively split in two. Specifically, the first and the second stoppers 51 and 52 respectively have portions forming planar end surfaces 51*a* and 52*a* which are inserted into the vertical center line X side of the holes 20*e* and 20*e*, and portions forming spherical end surfaces 51*b* and 52*b* with the step portions 20*ed* and 20*ed* between them. These two portions are integrally connected respectively with screws or the like not shown.

Clearances are respectively given in a longitudinal direction between connecting portions of the portions forming the end surfaces 51*a* and 52*a* and the portions forming the end surfaces 51*b* and 52*b* of the first stopper 51 and the second stopper 52, and the step portions 20*ed* and 20*ed*. Consequently, the first stopper 51 and the second stopper 52 are slidable in the longitudinal direction corresponding to the clearances. Further, lengths Ls1 and Ls2 of the first and the second stoppers 51 and 52 are determined so that the horizontal positions of the planar end surfaces 51*a* and 52*a* from the vertical center line X are at predetermined positions corresponding to dimensions LE1 and LE2 (See FIG. 3B) of the thick-walled elbow material 111*b* after forming.

The lower guide 30 for bearing the lower die 20 has slide guides 31 and 32 provided with slide surfaces 30*a* and 30*a* which lower end portions 20*f* and 20*f* of the pair of bottom dies 21 and 22 of the lower die 20 abut to and slide on. The lower guide 30 has a lower center die 33 provided with a protruded portion 33*a* on the vertical center line X and with a groove 30*c* in a circular arc form conforming to the outer shape of the thick-walled elbow material 111*b* after forming. The slide guides 31 and 32 and the lower center die 33 are attached to the fixed frame 90 with bolts or the like not shown.

The slide guides 31 and 32 and lower center die 33 of the lower guide 30 are provided with two grooves 30*b* and 30*b* with U-shaped sections opened upward in order to avoid interference occurring when the pair of support rods 41 and 41 descend. The slide guides 31 and 32 and the lower center die 33 may be separate or integral. The slide surfaces 30*a* and 30*a* of the slide guides 31 and 32 are formed to be oblique surfaces slanting downward toward the vertical center line X, but it can go without saying that they may be horizontal surfaces or may be oblique surfaces with the slant in the reverse direction.

As shown in FIG. 2C being a sectional view taken along the line 2C—2C in FIG. 1, the support grooves 20*b* and 20*b* of the bottom dies 21 and 22 are respectively provided at both sides of the lower portions of the bottom dies 21 and 22. The lower guide 30 is provided with the grooves 30*b* and 30*b* at both sides. As a result that the support grooves 20*b* and 20*b* are respectively provided at both sides of the lower portions of the bottom dies 21 and 22, the bottom dies 21 and 22 can be placed on the pair of support rods 41 and 41 with stability.

The support 40 has the pair of support rods 41 and 41, support guides 42 and springs 43. Guide holes 40*a* and 40*a* are provided at both end portions in a longitudinal direction of the support rod 41. The support guide 42 is inserted into the guide hole 40*a* and the spring 43. The support guide 42 is fixed to the fixing frame 90. Further, a stopper portion 42*a* for preventing the support rod 41 from slipping off is provided at an upper end portion of the support guide 42. Consequently, the support rod 41 slides along the support guide 42 and is movable up and down. Further, the support rod 41 is given momentum upward by the spring 43, and holds the bottom dies 21 and 22 placed thereon. Stoppers 41*a* and 41*a* for positioning the bottom dies 21 and 22 in the horizontal direction are provided at symmetrical positions with the vertical center line X therebetween near a center of the support rod 41. Instead of being given upward momentum by the support guide 42 and the spring 43, the support rod 41 may be hung with a spring via a bracket, which may be provided with a stopper for stopping ascent, thereby giving upward momentum to the support rod 41.

Next, the operation of the first embodiment will be explained according to a forming method of the thick-walled pipe material 111*a*.

Figure 3A:
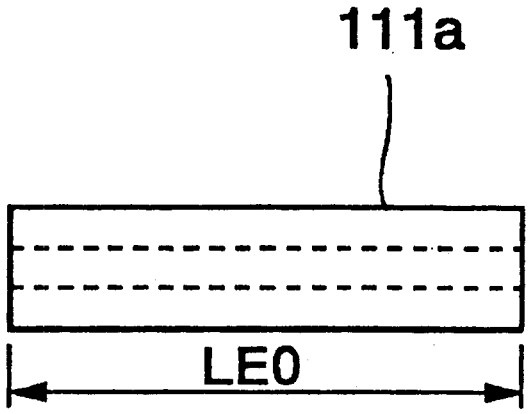
FIG. 3A and FIG. 3B are views showing a form of a material of a thick-walled elbow according to the first embodiment.
Figure 4A:
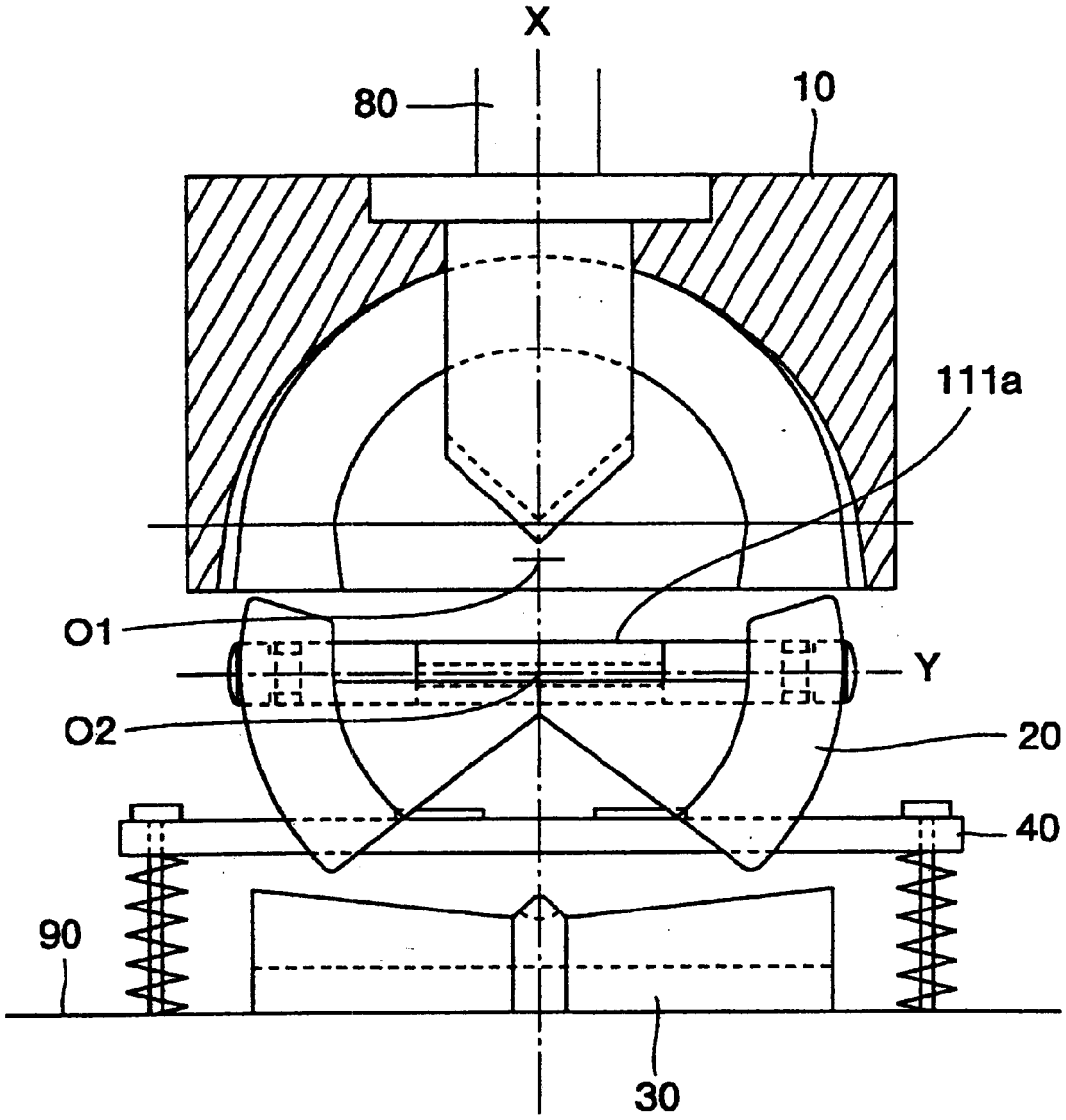
FIG. 4A, FIG. 4B, FIG. 4C and FIG. 4D are explanatory views showing working steps according to the first embodiment.

Initially, a predetermined length LEO of the thick-walled pipe material 111*a* (hereinafter, called the pipe material 111*a*) as shown in FIG. 3A is cut at a right angle to a longitudinal direction. Then, as shown in FIG. 4A, with the ram 80 such as a press being fixed at a rising end position, and with the upper die 10 and the lower die 20 being separated from each other, the pipe material 111*a* is placed on the lower die 20.

Figure 4B:
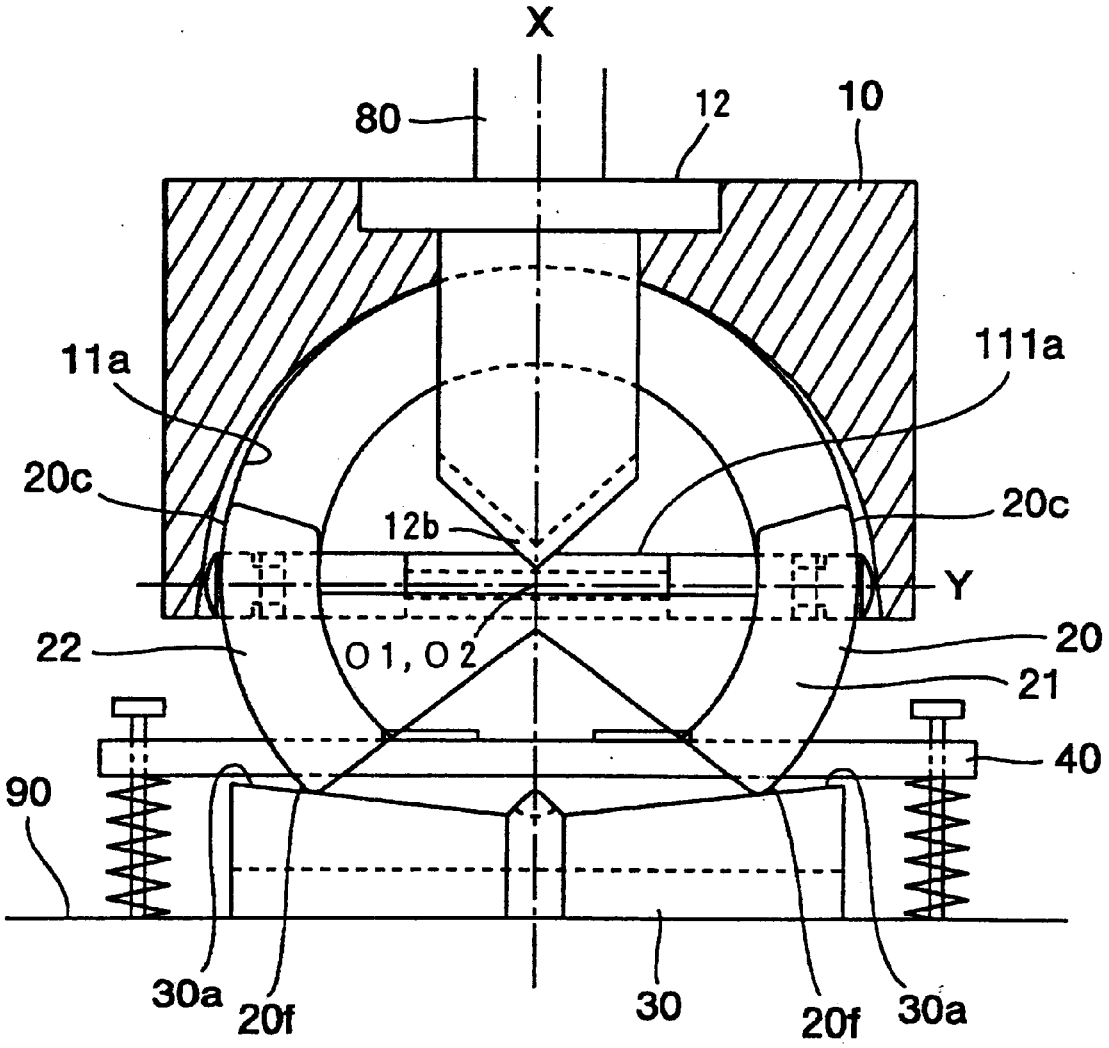

Subsequently, as shown in FIG. 4B, when the ram 80 is lowered to thereby lower the upper die 10, the protruded portion 12*b* of the presser die 12 of the upper die 10 abuts to the pipe material 111*a*. Simultaneously, the sliding surfaces 20*c* and 20*c* of the pair of bottom dies 21 and 22 of the lower die 20 begin to abut to the guide surface 11*a* in the circular arc form of the upper die 10. The lower end portions 20*f* and 20*f* of the bottom dies 21 and 22 then abut to the slide surfaces 30*a* and 30*a* of the lower guide 30 to start press-bending.

In this situation, the center O1 of the radius R1 of the guide surface 11*a* in the circular arc form of the upper die 10 corresponds to the center O2 of the radius R1*a* of the sliding surfaces 20*c* and 20*c* of the pair of bottom dies 21 and 22 of the lower die 20. Consequently, the sliding surfaces 20*c* and 20*c* abut to and slide along the guide surface 11*a*, and thus the bottom dies 21 and 22 can smoothly rotate around the center O1.

Figure 4C:
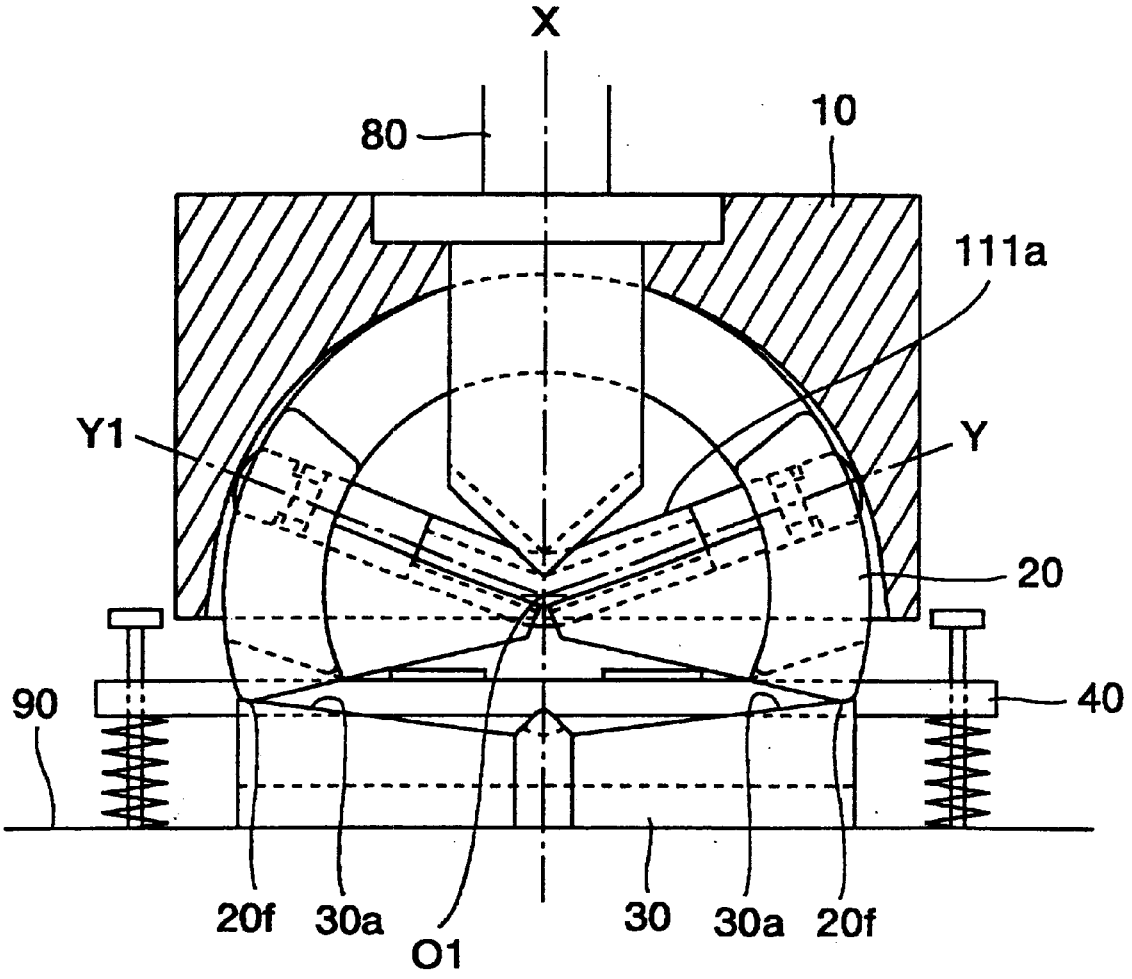

As shown in FIG. 4C, when the ram 80 such as a press is further lowered to thereby lower the upper die 10, in connection with this, the respective sliding surfaces 20*c* and 20*c* of the bottom dies 21 and 22 abut to and slide along the guide surface 11*a* of the upper die 10 toward the upper portion of the guide surface 11*a*. Simultaneously, the lower end portions 20*f* and 20*f* of the bottom dies 21 and 22 abut to and slide along the slide surfaces 30*a* and 30*a* in a direction away from the vertical center line X. Then the bottom dies 21 and 22 face to each other so as to have the center O1 of rotation on the vertical center line X respectively, and they rotate so that a relative angle made by the upper surfaces is made smaller. At the same time, the downward press-bending force of the upper die 10 lowers the support 40.

Figure 4D:
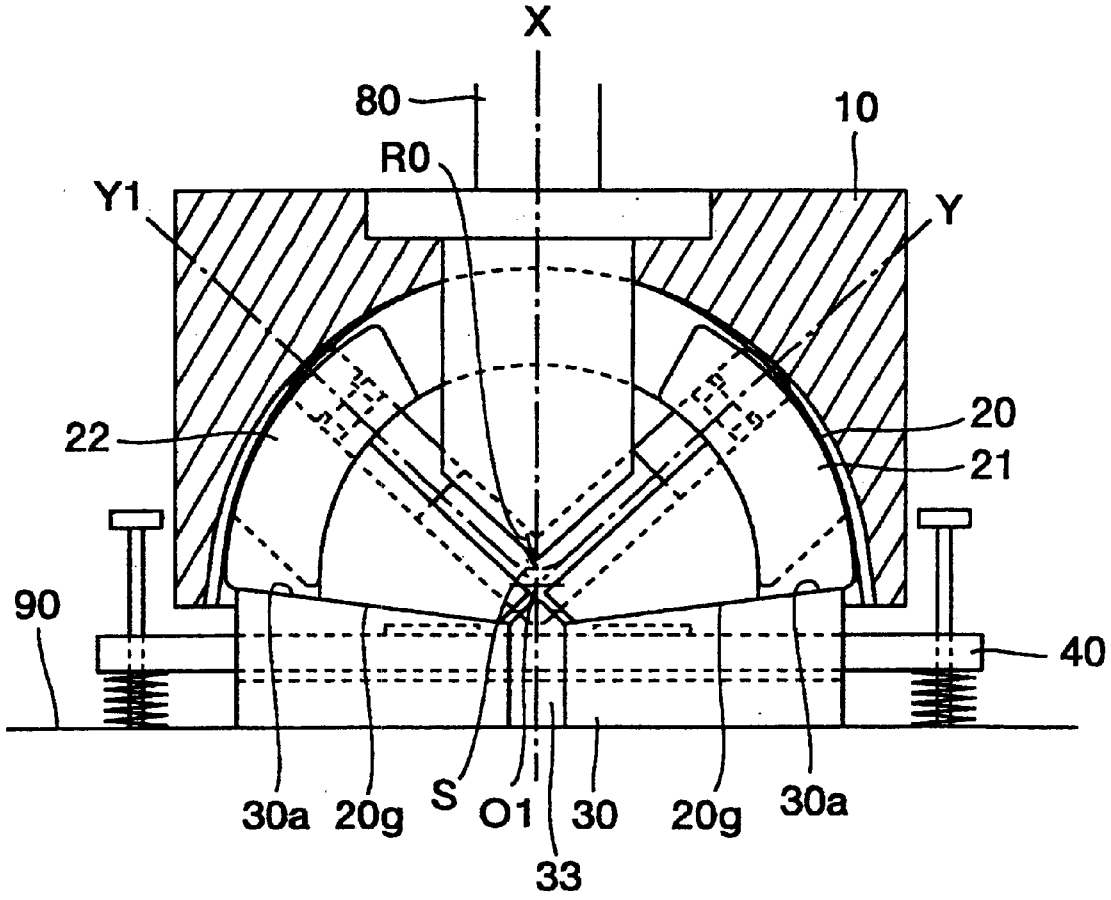

A center line Y of the pipe material 111*a* passes through the center O1 of rotation at the time of start of the bending as shown in FIG. 4B. As shown in FIG. 4D, when the bending proceeds, the center line Y curves to be a curved line S having a very small radius R0 of, for example, 12 mm, in the vicinity of the center O1 with the center O1 of rotation being as a boundary, connects to a center line Y1, and the bending angle approaches a right angle. In this situation, the center line Y and the center line Y1 rotate with a point of intersection thereof being the center O1 so that an angle formed by the center line Y and the center line Y1 becomes small.

The pipe material 111*a* is pressed and crushed by the presser die 12 by bending, whereby thickness at a center portion in a longitudinal direction of the pipe material 111*a* on the upper side from the center line Y and the center line Y1 is compressed. As a result, thickness at the center portion in the longitudinal direction of the pipe material 111*a* on the lower side from the center line Y and the center line Y1 is elongated. Thus, the thickness at the compressed side tries to move to the elongated side on the lower side from the center line Y and the center line Y1, but the grooves 20*a* and 20*a* with the circular arc sections of the lower die 20 restrain it so that the thickness cannot move to any other places and thus move in the longitudinal direction of the pipe material 111*a*.

The pipe material 111*a* then extends in the longitudinal direction, and both end surfaces of the pipe material 111*a* try to push the planar end surfaces 51*a* and 52*a* of the first stopper 51 and the second stopper 52. However, since the spherical end surfaces 51*b* and 52*b* of the first stopper 51 and the second stopper 52 abut along the stopper guide surfaces 11*c* and 11*c* in the circular arc form of the upper guide 11, the planar end surfaces 51*a* and 52*a* serve as the stoppers for both the end surfaces of the pipe material 111*a* to restrain the movement of the thickness of the pipe material 111*a*.

The spherical end surfaces 51*b* and 52*b* respectively abut to and slide along the stopper guide surfaces 11*c* and 11*c* in the circular arc form, and the stopper guide surfaces 11*c* and 11*c* are made closer to the guide surface 11*a* as they are at the upper portion of the upper guide 11. In other words, the stopper guide surfaces 11*c* and 11*c* are designed to be closer to the center O1 being the center of rotation of the pair of bottom dies 21 and 22 as they are at the upper portion of the upper guide 11. Consequently, the first stopper 51 and the second stopper 52 are slidable in the longitudinal direction by the longitudinal length of the clearance between the step portions 20*ed* and 20*ed* at the center portion and the first and the second stoppers 51 and 52, and thus they push against both the end surfaces of the pipe material 111*a*. In other words, following the rotation of each of the pair of bottom dies 21 and 22, the planar end surfaces 51*a* and 52*a* press both the end surfaces of the pipe material 111*a* toward the center O1, thereby limiting the movement of the thickness of the pipe material 111*a*.

Further, when the upper die 10 is lowered, the lower surfaces 20*g* and 20*g* of the bottom dies 21 and 22 abut to the slide surfaces 30*a* and 30*a* of the lower guide 30 as shown in FIG. 4D. Thereupon, the upper die 10 stops descending as the slide surfaces 30*a* and 30*a* serves as stoppers.

Further, as the pair of lower dies 21 and 22 rotate, their end surfaces 21*g* and 22*g* abutting to each other on the vertical center line X are separated, and thereby a space occurs. However, when the bending proceeds and the lower central portion of the pipe material 111*a* abuts to the lower center die 33 having the groove 30*c* in the circular arc form of the lower guide 30, the groove 30*c* limits the movement of the thickness at the lower central portion of the pipe material 111*a*. As a result, the thickness at the upper central portion of the pipe material 111*a*, which is compressed and crushed by the presser die 12, cannot move to any other places and move in the longitudinal direction of the pipe material 111*a*.

Then the spherical end surfaces 51*b* and 52*b* abut to and slide along the stopper guide surfaces 11*c* and 11*c* in the circular arc form as described above, and thus the planar end surfaces 51*a* and 52*a* serve as the stoppers for both the end surfaces of the pipe material 111*a* to limit the movement of the thickness of the pipe material 111*a*.

Further, since the stopper guide surfaces 11*c* and 11*c* are made to be closer to the guide surface 11*a* as they are at the upper portion of the upper guide 11, the planar end surfaces 51*a* and 52*a* are pushed toward the center O1 of rotation as described above. Consequently, since the first and the second stoppers 51 and 52 are respectively slidable in the longitudinal direction by the longitudinal length of the clearance between the step portions 20*e d* and 20*e d* and the first and the second stoppers 51 and 52, they push against both the end surfaces of the pipe material 111*a*.

Figure 3B:
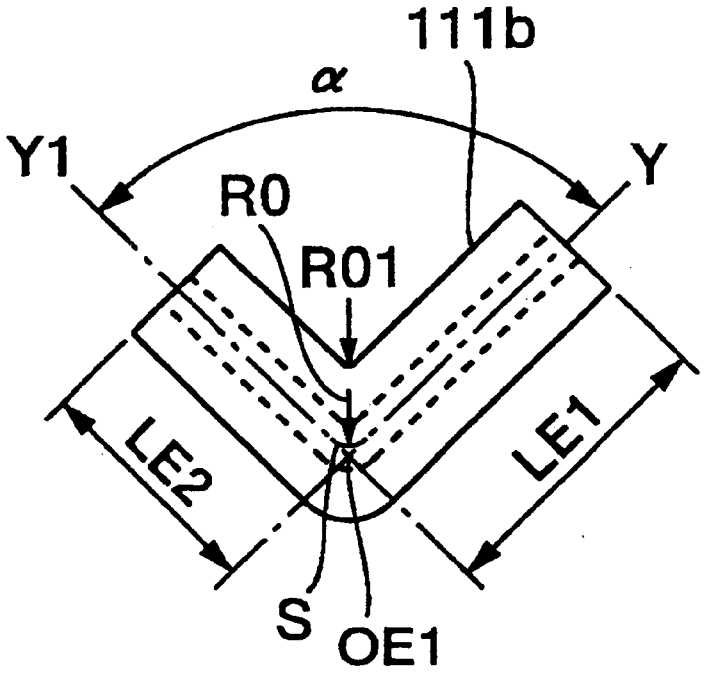

Accordingly, as shown in FIG. 4D, the pipe material 111*a* is bent so that its center line joins the center line Y and the center line Y1 via the curved line S. As the result, the center line of the pipe material 111*a* joins the center line Y, the curved line S with the radius R0 near the intersection point OE1 of the center line Y and the center line Y1, and the center line Y1 as shown in FIG. 3B. Thus, the thick-walled elbow material 111*b* having the predetermined bending angle α with the predetermined lengths LE1 and LE2 from both the end surfaces to the intersection point OE1 is formed. On the bending work, the intersection point OE1 of the center line Y and the center line Y1 corresponds to the center O1 of rotation described above.

Specifically, the pipe material 111*a* is accurately formed to be in a size set by the spherical end surface 51*b* of the first stopper 51 and the spherical end surface 52*b* of the second stopper 52 abutting along the stopper guide surfaces 11*c* and 11*c* in the circular arc form. Subsequently, the upper die 10 is raised to return to the state shown in FIG. 4A, whereby the thick-walled material 111*b* after the forming is taken out. The pipe material 111*a* may be heat-treated and thereafter placed on the lower die 20 to be bent.

As described above, since the thick-walled pipe material 111*a* is restrained by the upper die 10, the pair of bottom dies 21 and 22, the first stopper 51, the second stopper 52 and the lower center die 33 to be formed, it can be accurately formed to be the thick-walled elbow material 111*b* in a predetermined size and shape.

On the bending work, the point of intersection of the center line Y and the center line Y1 of the pipe material 111*a* is on the center O1 being the center of rotation of the bottom dies 21 and 22. Accordingly, regarding the bottom dies 21 and 22 and the pipe material 111*a,* the relative positions in the longitudinal direction on the center lines Y and Y1 do not change even if the bottom dies 21 and 22 rotate. In other words, when the bottom dies 21 and 22 rotate, frictional force works between the pipe material 111*a* and the bottom dies 22 and 22 by the compression force of the upper die 10, but the frictional force works so that the distance between the positions of both the end surfaces of the pipe material 111*a* and the center O1 are not changed.

Accordingly, both the end surfaces of the pipe material 111*a* are restrained in the range of the aforesaid frictional force relative to the center O1, thus reducing the change in the size of the pipe material occurring at the start and the completion of the bending, which is caused by the bending work, as described in the above Japanese Patent Laid-open No. 59-163024. As a result, even if the first stopper 51 and the second stopper 52 are not provided, the thick-walled elbow material 111*b* with less variations in the predetermined lengths LE1 and LE2 from the point of intersection OE1 to both the end surfaces can be formed.

Figure 5:
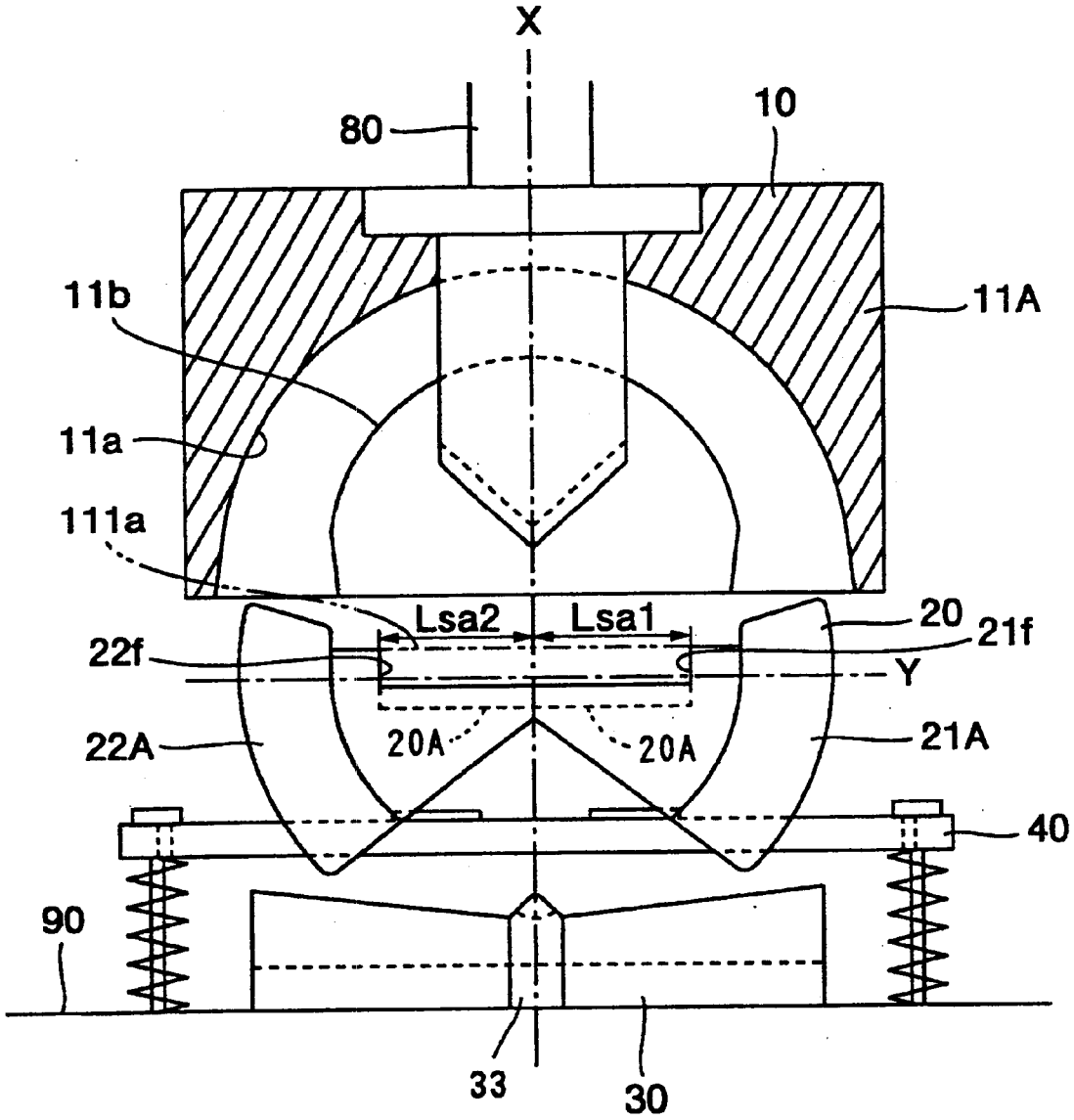
FIG. 5 is an explanatory view of an apparatus for manufacturing a thick-walled bent pipe according to a second embodiment of the present invention.

Next, a second embodiment will be explained with FIG. 5. It should be noted that the same components as in the first embodiment are given the identical reference numerals and symbols and the detailed explanation thereof will be omitted.

Unlike the first embodiment, an upper guide 11A of the upper die 10 are not provided with the stopper guide surfaces 11*c* and 11*c* in the circular arc form with the radius R3. The upper guide 11A is provided with the guide surface 11*a* in the circular arc form having the center O1 on the vertical center line X with the radius R1 for guiding the lower die 20, and the inner guide surface 11*b* in the circular arc form with the radius R2.

The lower die 20 is defined by a pair of bottom dies 21A and 22A. Unlike the first embodiment, the pair of bottom dies 21A and 22A are not provided with the holes 20*e* and 20*e* for inserting the first stopper 51 and the second stopper 52 therein, but are provided with stopper portions 21*f* and 21*f* respectively. Horizontal distances Lsa1 and Lsa2 of the stopper portions 21*f* and 22*f* from the vertical center line X are determined according to a size of the thick-walled elbow material 111*b* after the forming.

Next, the operation of the second embodiment will be explained.

When the bending work is performed by placing the pipe material 111*a* on the lower die 20, the pipe material 111*a* is compressed and crushed by the presser die 12 of the upper die 10 by bending. As a result, thickness at a center portion in a longitudinal direction at the upper side from the center line Y of the pipe material 111*a* tries to move to a lower side from the center line Y, but it is restrained by the grooves 20*a* and 20*a* with the circular arc sections of the lower die 20 and thus it cannot move to any other places, therefore moving in the longitudinal direction of the pipe material 111*a*.

Thereupon, the pipe material 111*a* tries to extend in the longitudinal direction, but the stopper portions 21*f* and 22*f* of the bottom dies 21A and 22A serve as the stoppers for both the end surfaces of the pipe material 111*a*, and limit the movement of the thickness of the pipe material 111*a*.

In this case, since the pair of bottom dies 21A and 22A respectively rotate around the O1 being the center of rotation as in the first embodiment, as for the stopper portions 21*f* and 22*f*, the distances from the center O1 being the center of rotation do not change during rotation. Consequently, the distances between both the end surfaces in the longitudinal direction of the pipe material 111*a* and the center O1 do not change even while the bottom dies 21A and 22A are rotating in the bending work. Thus, the size of the pipe material 111*a* is accurately formed in the size of the thick-walled elbow material 111*b* after the forming, which is determined by the distances Lsa1 and Lsa2 of the stopper portions 21*f* and 22*f* from the vertical center line X.

Accordingly, the thick-walled pipe material 111*a* is formed while being restrained by the upper die 10, the lower die 20, and the lower center die 33, thus making it possible to form the thick-walled pipe material 111*a* to be in a predetermine size and shape. Further, since the bottom dies 21A and 22A are provided with the stopper portions 21*f* and 22*f*, the number of components of the lower die 20 is reduced. The other operations and effects are the same as those in the first embodiment, and the explanation thereof will be omitted.

Figure 6:
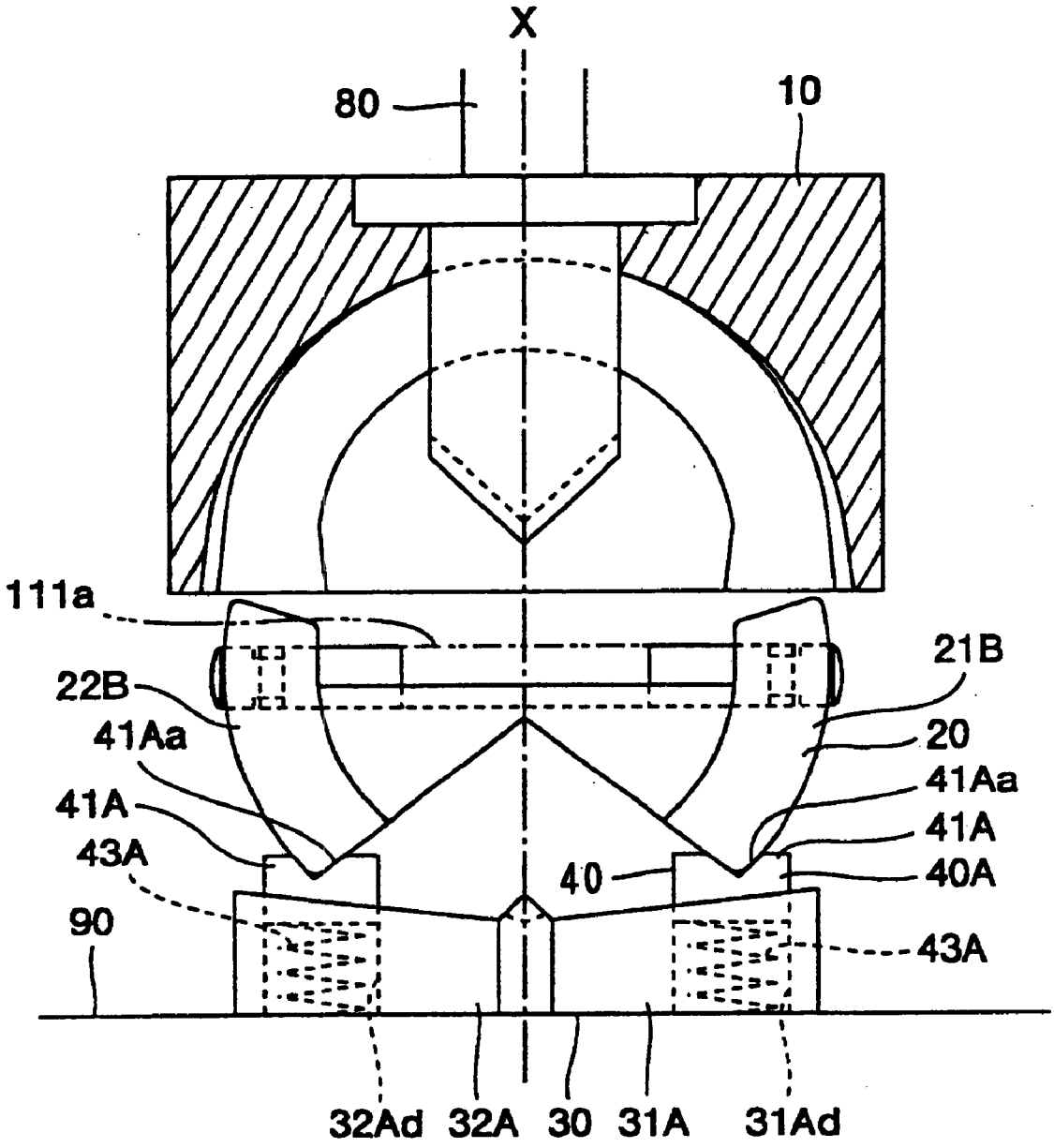
FIG. 6 is an explanatory view of an apparatus for manufacturing a thick-walled bent pipe according to a third embodiment of the present invention.

Next, a third embodiment will be explained based on FIG. 6. It should be noted that the same components as in the first embodiment are given the identical reference numerals and symbols and the detailed explanation thereof will be omitted.

The lower die 20 is defined by a pair of the bottom dies 21B and 22B. The support grooves 20*b* and 20*b* as are provided in the bottom dies 21 and 22 in the first embodiment are not provided in lower portions of the bottom dies 21B and 22B. The support 40 has a pair of support mounts 41A and 41A having V-shaped grooves 41A*a* for supporting the lower portions of the pair of bottom dies 21B and 22B, and a pair of springs 43A and 43A.

The support mounts 41A and 41A and the springs 43A and 43A are inserted into guide holes 31A*d* and 32A*d* respectively provided in slide guides 31A and 32A of the lower guide 30. The support mount 41A and 41A are given upward momentum by the spring 43A and 43A to hold the bottom dies 21B and 22B placed thereon.

In the above configuration, when the pipe material 111*a* is placed on the lower die 20 to be bent as in the first embodiment, the support mounts 41A and 41A are pushed into the guide holes 31A*d* and 32A*d* of the slide guides 31A and 32A by the bottom dies 21B and 22B which are descending. Consequently, the pair of bottom dies 21B and 22B of the lower die 20 can be supported by the support mounts 41A and 41A with stability.

According to the third embodiment, it is not necessary to perform working to provide grooves in the lower portions of the pair of bottom dies 21B and 22B of the lower die 20, thus making it possible to reduce working cost. Further, the support 40 has the pair of support mounts 41A and 41A and the pair of springs 43A and 43A, which makes the number of components four, thus reducing the number of components compared with the first embodiment in which the number of components of the support 40 is 10. Accordingly the production cost of the components can be reduced. Since the other operations and effects are the same as those in the first embodiment, and the explanation thereof will be omitted.

In each of the embodiments of the present invention explained above, the bending angle α of the thick-walled pipe material 111*a* can be optionally set by adjusting the descending stroke of the upper die 10. Accordingly, not only the right-angled thick-walled elbow material 111*b* but also the thick-walled elbow material 111*b* with the bending angle α of, for example, 45 degrees or 60 degrees can be manufactured, thus making it possible to manufacture various kinds of thick-walled elbow materials 111*b* with use of one kind of dies.

In the first and the third embodiment, a plurality of first stoppers 51 and second stoppers 52 with the length Ls1 and Ls2 being varied respectively may be prepared, and by properly selecting and using them, the sizes of the predetermined lengths LE1 and LE2 of the thick-walled elbow material 111*b* can be set optionally. Accordingly, by only replacing the first stopper 51 or the second stopper 52, various kinds of thick-walled elbow materials 111*b* can be manufactured with use of one kind of dies.

Figure 7:
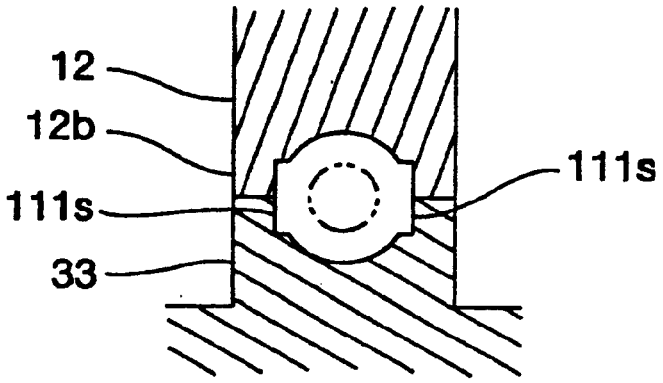
FIG. 7 is a sectional view of another example of groove forms of a presser die and a lower center die according to the present invention.
Figure 8:
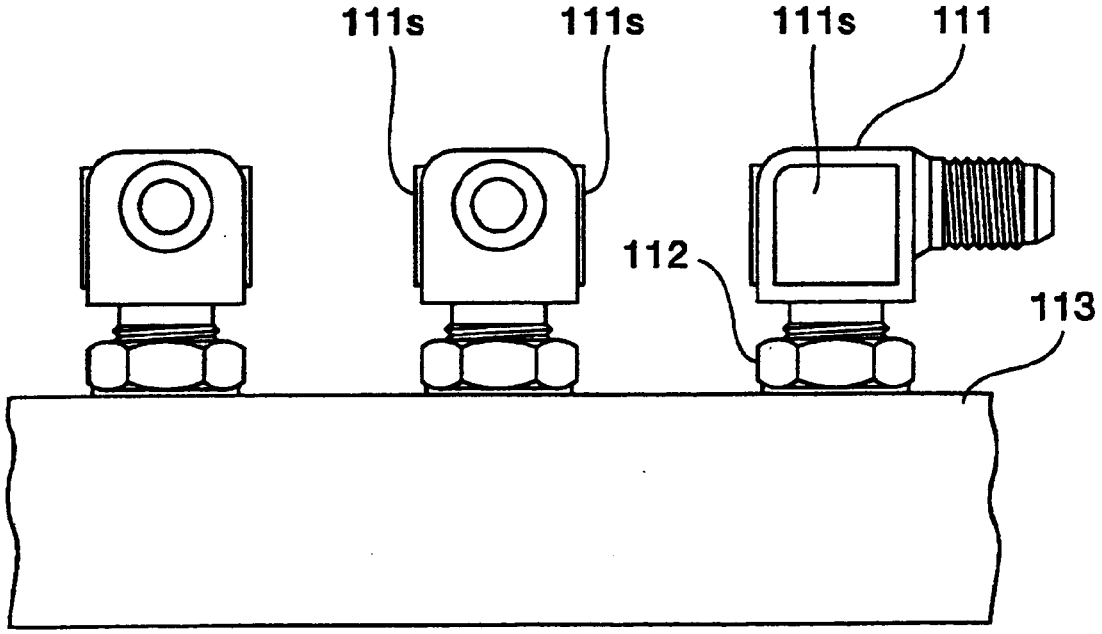
FIG. 8 PRIOR ART
FIG. 8 is an explanatory view showing a conventional elbow for piping.
Figure 9:
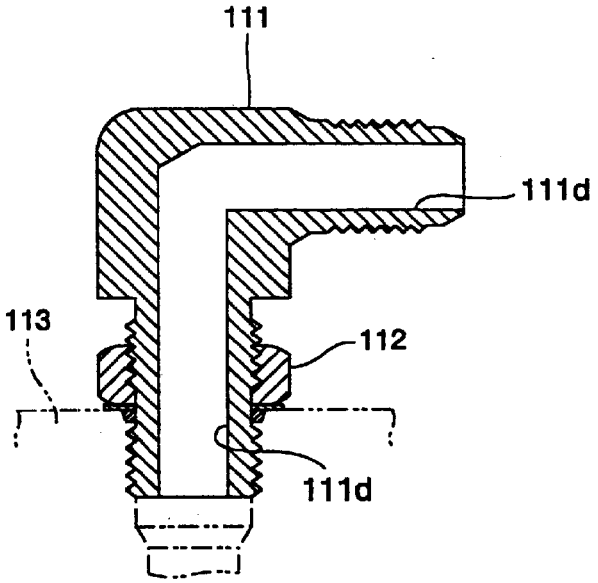
FIG. 9 PRIOR ART
FIG. 9 is a sectional view of an elbow body in FIG. 8.
Figure 10:
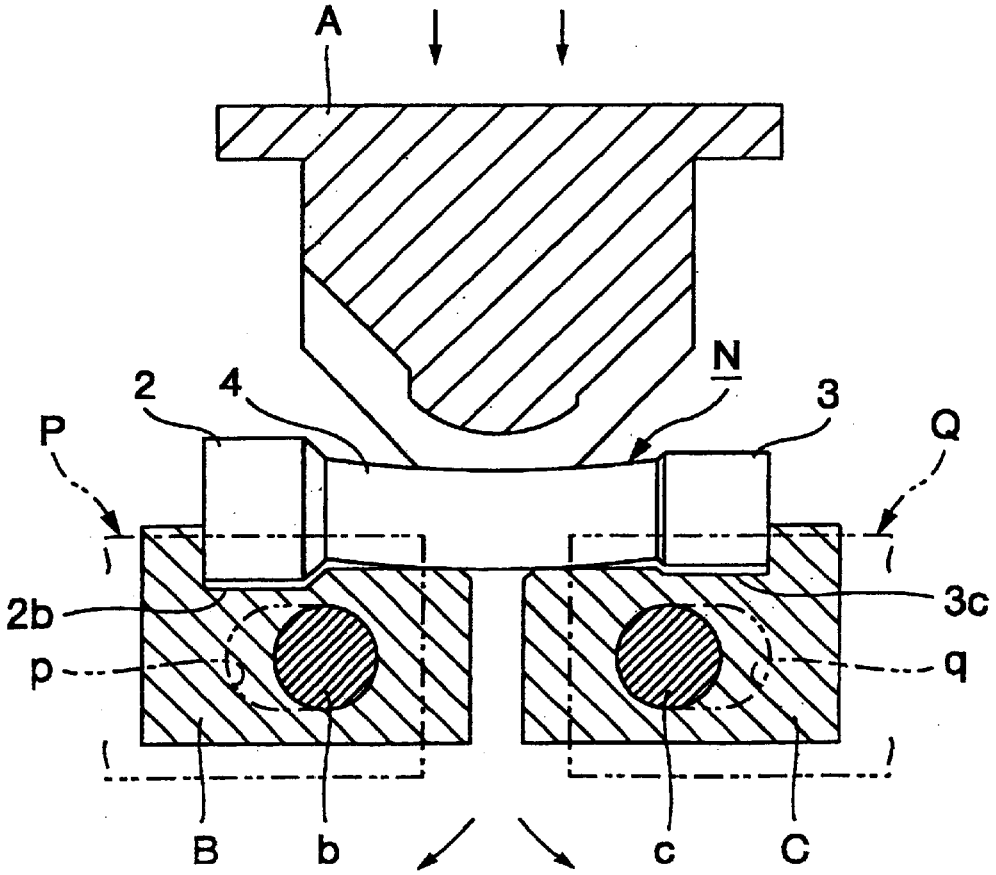
FIG.10 PRIOR ART
FIG. 10 and FIG. 11 are explanatory views of a conventional method for manufacturing a curved pipe material.
Figure 11:
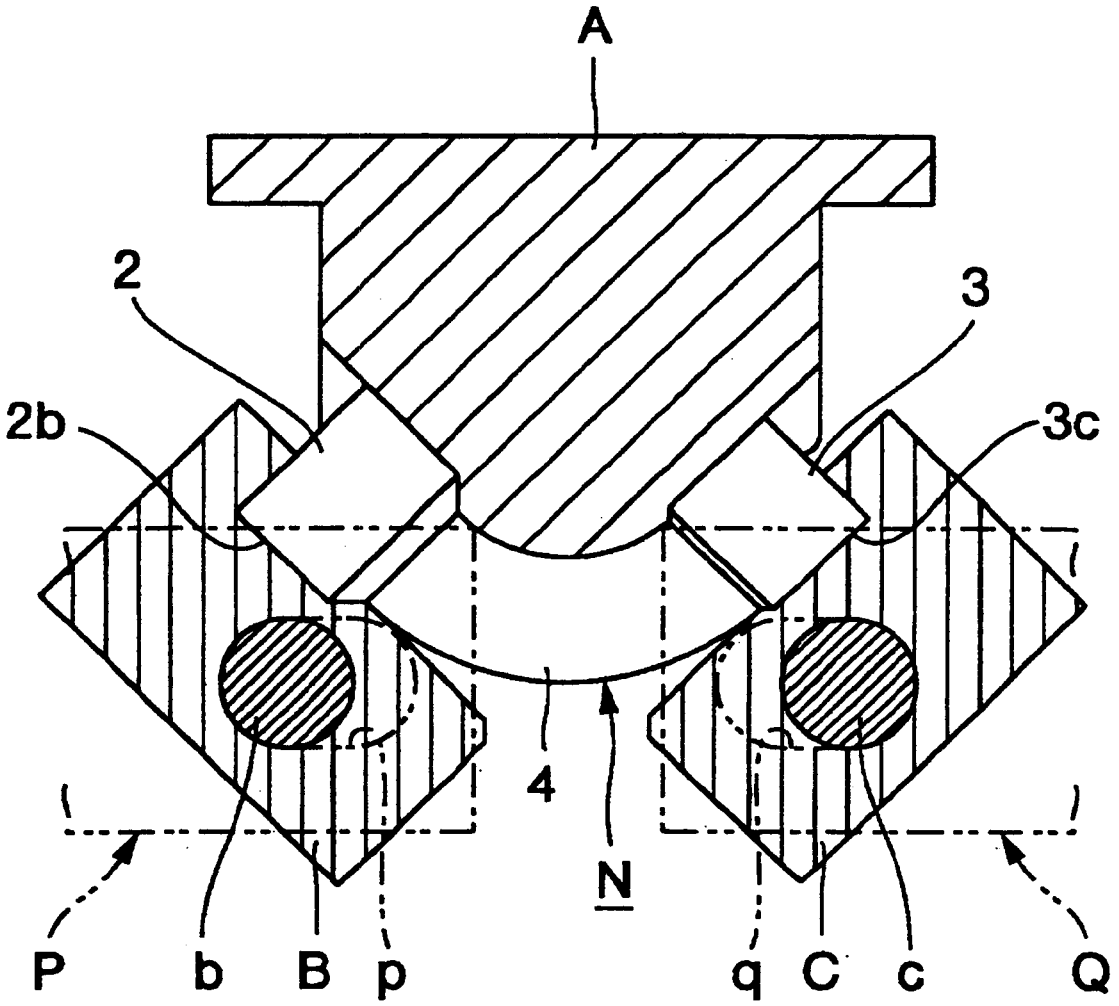
FIG.11 PRIOR ART
Figure 12A:
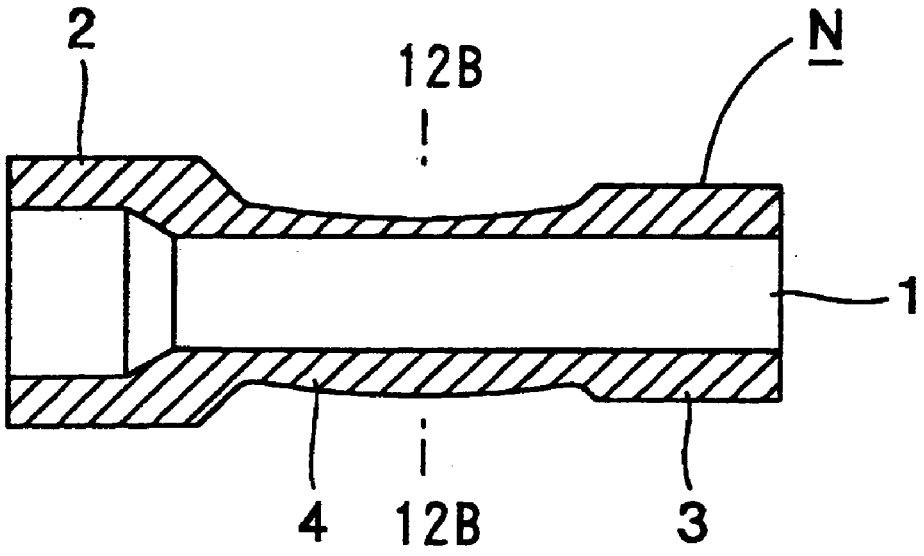
FIG. 12A PRIOR ART
FIG. 12A is a sectional view of the straight pipe-shaped semiprocessed product obtained by the conventional method for manufacturing the curved pipe material.
Figure 12B:
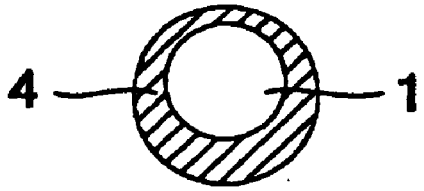
FIG. 12B PRIOR ART
FIG. 12B is a section taken along the 12B—12B line in FIG. 12A.

Further, as shown in FIG. 7, the grooves in the protruded portion 12*b* of the presser die 12 and the lower center die 33 may be formed into a U-shape with a large width, and thereby plane portions 111*s* and 111*s* for a spanner can be formed at both sides of the center portion of the elbow. Accordingly, assembly can be done with a spanner being securely abutted to the plane portions 111*s* and 111*s* as necessary, thus making it possible to manufacture the thick-walled elbow material 111*b* with further improved assembling ease.

The support 40 is for supporting the bottom dies 21, 22, 21A, 22A, 21B and 22B of the lower die 20 with stability. However, each pair of the bottom dies 21 and 22, 21A and 22A, 21B and 22B may be faced to each other with the respective end surfaces 21*g* and 22*g* being abutted to each other, and may be directly placed on the slide surfaces 30*a* and 30*a* of the lower guide 30 to be set, without using the support 40.

In order to evaluate the method and the apparatus for manufacturing the thick-walled bent pipe of the present invention, 60 mm of a thick-walled pipe material of high-carbon steel, with a diameter of 20 mm and thickness of 7 mm was cut out and provided as the pipe material 111*a*. After the portion to be bent of the pipe material 111*a* was heat-treated at about 1000° C., bending work was performed at the bending angle of 90 degrees. As the result, crushing of the inner diameter portion almost did not occur, the thick-walled elbow member 111*b* excellently formed in a set accurate size with the length LE1 of 35 mm and LE2 of 25 mm was obtained.

As explained thus far, according to the method and the apparatus for manufacturing the thick-walled bent pipe of the present invention, the pair of bottom dies 21 and 22 of the lower die 20 rotate along the guide surface 11*a* of the upper die with the center O1 on the vertical center line X. As a result, the change in the distances between both the end surfaces of the thick-walled pipe material 111*a* and the center O1 of rotation at the start of the bending and at the end of the bending is reduced, thus making it possible to form the thick-walled elbow material 111*b* with less variations in size.

Bending work is performed with the thick-walled pipe material 111*a* being restrained so that it has the length set by the upper die 10, the lower die 20 and the stopper 50 of the lower die, thus making it possible to form the thick-walled elbow material 111*b* of accurate size.

The hole in the thick-walled elbow material 111*b* thus formed is not a drill-hole which is crossed as in the prior art, but is a smoothly curved hole, thus making it possible to reduce the pressure loss of a fluid passing through the elbow. Further, the bending angle α can be set at will by adjusting the descending stroke of the upper die 10, thus making it possible to manufacture various kinds of thick-walled elbow materials 111*b* with different bending angles α.

The first stopper 51 and the second stopper 52 are respectively slidable in the longitudinal direction. The spherical end surfaces 51*b* and 52*b* of the first stopper 51 and the second stopper 52 abut to and slide along the guide surface 11*a* in the circular arc form of the upper guide 11 of the upper die 10, which is closer to the center O1 being the center of rotation of the pair of bottom dies 21 and 22 at the upper portion of the upper guide. Thus, the planar end surfaces 52*a* and 51*a* of the first stopper 51 and the second stopper 52 can push against both the end surfaces of the pipe material 111*a* during bending work while they serve as stoppers for both the end surfaces of the pipe material 111*a*.

As a result, the pipe material 111*a* can be accurately formed to be the thick-walled elbow material 111*b* of a size set by the end surface 51*b* of the first stopper 51 and the end surface 52*b* of the second stopper 52 respectively abutting to the guide surface 11*a* of the upper guide 11.

What is claimed is:

1. A method for manufacturing a thick-walled bent pipe, comprising the steps of:

placing a thick-walled metal pipe material of a predetermined length between end-surfaces on a lower die which includes a pair of bottom dies each having a sliding surface in a circular arc form at one end, an end surface at the opposite end, a lower surface intermediate said sliding surface and said end surface, and a lower end portion at an intersection of said sliding surface and said lower surface;

placing said pair of bottom dies on slide surfaces of a lower guide;

pressing said thick-walled metal pipe material in a middle portion in a longitudinal direction of said thick-walled metal pipe material by means of an upper die which includes an upper guide having a guide surface in a circular arc form for guiding said lower die, and a presser die; said pressing thereby rotating said bottom dies respectively while said end surfaces are facing to each other, by lower end portions of said bottom dies respectively abutting to and sliding along said slide surfaces at the same time when said sliding surfaces abut to and slide along said guide surface in the circular arc form to thereby bend said thick-walled metal pipe material.

2. The method for manufacturing the thick-walled bent pipe in accordance with claim 1, wherein both end surfaces of said thick-walled metal pipe material are restrained by a stopper provided at each end surface so as to extend beyond each sliding surface in said bottom dies.

3. The method for manufacturing the thick-walled bent pipe in accordance with claim 2, wherein said upper guide is provided with stopper guide surfaces, and said stoppers include a first stopper and a second stopper which slide in said bottom dies in the longitudinal direction of said thick-walled metal pipe material, to push both end surfaces of said thick-walled metal pipe material toward said middle portion by action of said stopper guide surfaces on said first stopper and said second stopper guiding the stoppers to be closer to said guide surface in the circular arc form of said upper die as said first stopper and said second stopper are moved toward an upper portion of said upper guide.

4. An apparatus for manufacturing a thick-walled bent pipe from a thick-walled pipe material, comprising:

a lower die for supporting a thick-walled pipe material which includes a pair of bottom dies each having a sliding surface in a circular arc form at one end, an end surface at the opposite end, a lower surface intermediate said sliding surface and said end surface, and a lower end portion at an intersection of said sliding surface and said lower surface, an upper die which includes an upper guide having a guide surface in a circular arc form for guiding said lower die, and a presser die; and a lower guide having slide surfaces for placing said bottom dies thereon, wherein said bottom dies rotate respectively while said end surfaces are facing to each other, by lower end portions of said bottom dies respectively abutting to and sliding along said slide surfaces at the same time when said sliding surfaces respectively abut to and slide along said guide surface in the circular arc form by action of said upper die being pressed toward said lower die to form said thick-walled bent pipe.

5. The apparatus for manufacturing the thick-walled bent pipe in accordance with claim 4, further comprising a stopper abutting to both end surfaces of said thick-walled pipe material in a longitudinal direction of said thick-walled pipe material so as to extend beyond each sliding surface of said bottom dies.

6. The apparatus for manufacturing the thick-walled bent pipe in accordance with claim 5, wherein said stoppers include a first stopper and a second stopper which slide in said bottom dies in the longitudinal direction of said thick-walled pipe material;

wherein said upper guide is provided with stopper guide surfaces; and wherein said stopper guide surfaces respectively guide said first stopper and said second stopper so that said first stopper and said second stopper are closer to said guide surface in the circular arc form of said upper die as said first stopper and said second stopper are moved toward an upper portion of said upper guide.

* * * * *